US009066562B2

(12) United States Patent
Azar et al.

(10) Patent No.: US 9,066,562 B2
(45) Date of Patent: Jun. 30, 2015

(54) JEWELRY ARTICLE

(71) Applicant: HB Concepts, LLC, Springfiled, MA (US)

(72) Inventors: Petra Azar, New Hope, PA (US); Camile Hannoush, Springfield, MA (US)

(73) Assignee: HB Concepts, LLC, Springfield, MA (US)

( * ) Notice: Subject to any disclaimer, the term of this patent is extended or adjusted under 35 U.S.C. 154(b) by 36 days.

(21) Appl. No.: 13/875,989

(22) Filed: May 2, 2013

(65) Prior Publication Data

US 2014/0102138 A1 Apr. 17, 2014

Related U.S. Application Data

(60) Provisional application No. 61/713,860, filed on Oct. 15, 2012.

(51) Int. Cl.

| | |
|---|---|
| ***A44C 9/00*** | (2006.01) |
| ***A44C 5/00*** | (2006.01) |
| ***A44C 5/12*** | (2006.01) |
| ***A44C 17/02*** | (2006.01) |

(52) U.S. Cl.

CPC ... *A44C 9/00* (2013.01); *A44C 5/00* (2013.01); *A44C 5/12* (2013.01); *A44C 9/0046* (2013.01); *A44C 17/0233* (2013.01); *A44D 2203/00* (2013.01)

(58) Field of Classification Search

CPC ..... A44C 9/00; A44C 5/12; A44C 9/0053; A44C 14/02; A44C 9/0038; A44C 9/0046

USPC ..... 63/15.7, 15.3, 7, 3.1, 29.2, 500, 15, 63/15.2, 40, 900; 24/303

See application file for complete search history.

(56) References Cited

U.S. PATENT DOCUMENTS

| | | | | |
|---|---|---|---|---|
| 3,805,548 | A | 4/1974 | Matwijcow | |
| 3,901,045 | A | 8/1975 | Ballester | |
| 4,236,384 | A | 12/1980 | Daub | |
| 4,471,634 | A | 9/1984 | Kaplan | |
| 4,569,211 | A | 2/1986 | Lodrini | |
| 4,763,490 | A | 8/1988 | Bruner | |
| 4,815,180 | A * | 3/1989 | Elsener | 24/616 |
| 4,991,409 | A | 2/1991 | Creates | |
| 5,317,789 | A | 6/1994 | Levy | |
| 5,946,943 | A * | 9/1999 | Hanson | 63/12 |
| 5,996,374 | A * | 12/1999 | Bardisbanyan | 63/15 |

(Continued)

FOREIGN PATENT DOCUMENTS

| | | | | |
|---|---|---|---|---|
| DE | 10138989 A1 * | 2/2002 | | A44C 13/00 |
| DE | 20201100360 | 5/2012 | | |

(Continued)

*Primary Examiner* — Emily Morgan

(74) *Attorney, Agent, or Firm* — Levisohn Berger LLP

(57) ABSTRACT

A jewelry article with two member arms are connected at one end by a pivotable joint at the opposite end the arms are provided with posts that carry an insert between the two arms by extending into the recess of a bore-through of the insert where they are securely connected by magnets. A corresponding thread at the post and in the insert provides additional security for the placement of the insert. A leaf spring further provided in the hinge connection of the two member jewelry item to further ensure the secure closing of the jewelry item.

9 Claims, 8 Drawing Sheets

(56) References Cited

U.S. PATENT DOCUMENTS

| | | | | |
|---|---|---|---|---|
| 6,053,009 | A * | 4/2000 | Broggian | 63/38 |
| 6,354,106 | B1 | 3/2002 | Kataw | |
| 6,427,487 | B1 | 8/2002 | Morgan | |
| 6,568,214 | B2 * | 5/2003 | Wolff | 63/29.1 |
| 6,584,804 | B1 | 7/2003 | Freedman et al. | |
| 6,701,747 | B2 | 3/2004 | Hartgrove | |
| 6,748,764 | B1 | 6/2004 | Roemer | |
| 7,055,342 | B2 | 6/2006 | Minassian | |
| 7,143,607 | B2 | 12/2006 | Hartgrove | |
| 7,210,313 | B1 | 5/2007 | Kay | |
| 7,340,922 | B2 * | 3/2008 | La Belle | 63/13 |
| 7,770,413 | B2 * | 8/2010 | Tyler | 63/12 |
| 8,225,625 | B2 | 7/2012 | Heiden et al. | |
| 2002/0129619 | A1 * | 9/2002 | Wolff | 63/7 |
| 2002/0178749 | A1 * | 12/2002 | Katano | 63/15.7 |
| 2003/0159463 | A1 * | 8/2003 | Rosenberg | 63/15.7 |
| 2006/0230785 | A1 * | 10/2006 | La Belle | 63/12 |
| 2008/0256978 | A1 * | 10/2008 | Chan | 63/3.1 |
| 2009/0013720 | A1 * | 1/2009 | Altick | 63/3.1 |
| 2010/0083700 | A1 * | 4/2010 | Joseph et al. | 63/3.1 |
| 2011/0232329 | A1 * | 9/2011 | Boyd | 63/4 |

FOREIGN PATENT DOCUMENTS

| | | |
|---|---|---|
| EP | 0375565 | 6/1990 |
| FR | 2818877 | 7/2002 |
| IL | 133515 | 5/2003 |
| JP | 2010022698 A | 4/2013 |

* cited by examiner

FIG. 13
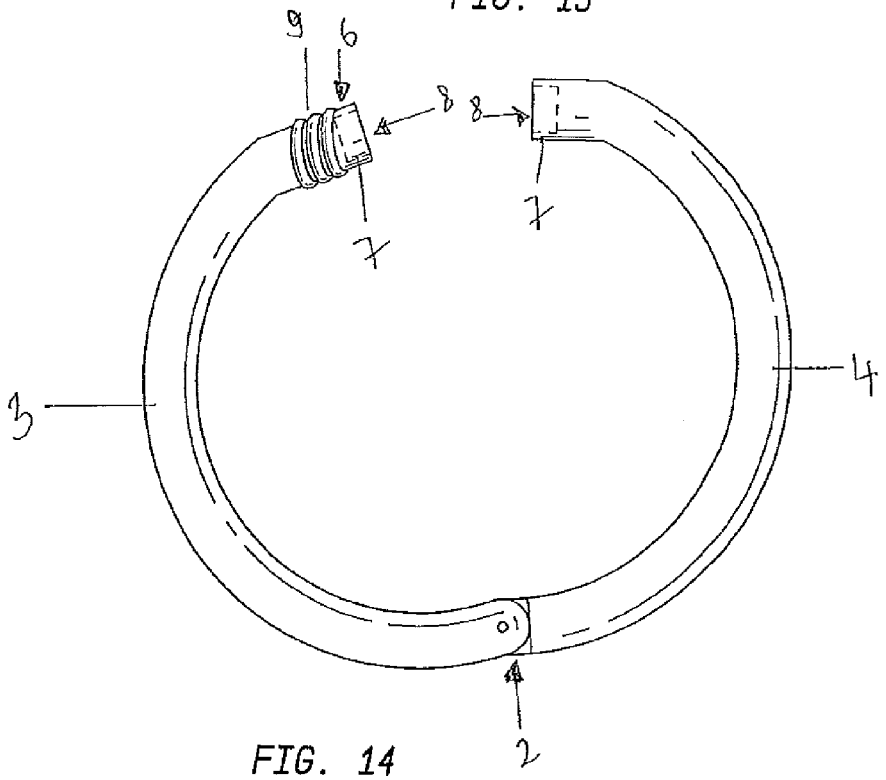
FIG. 14
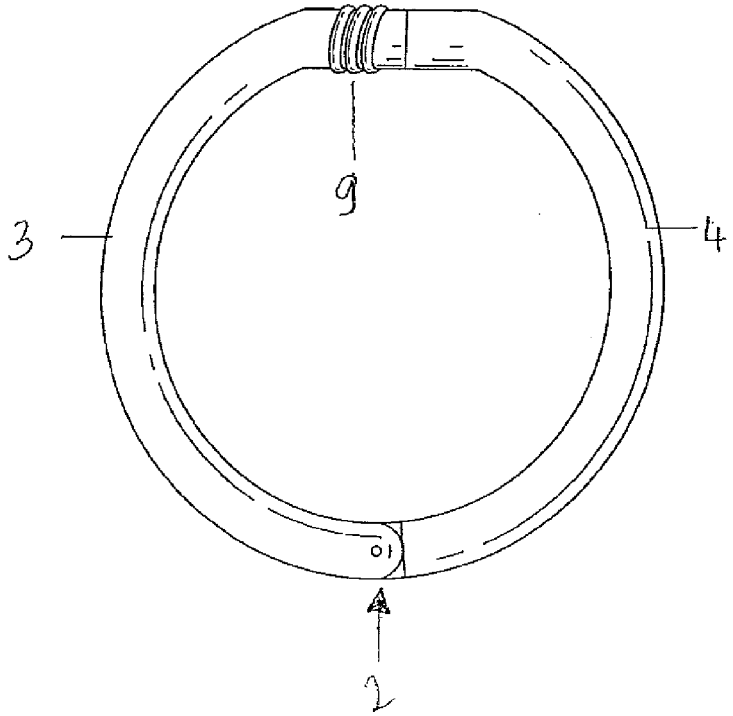
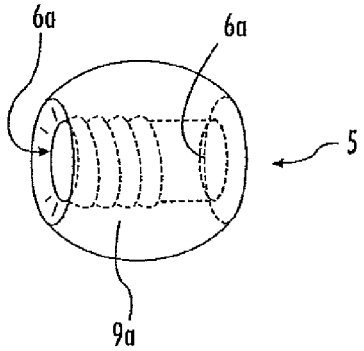
FIG. 15

FIG. 16
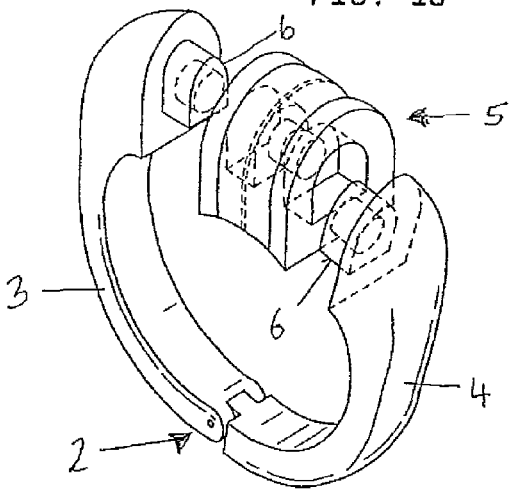
FIG. 17
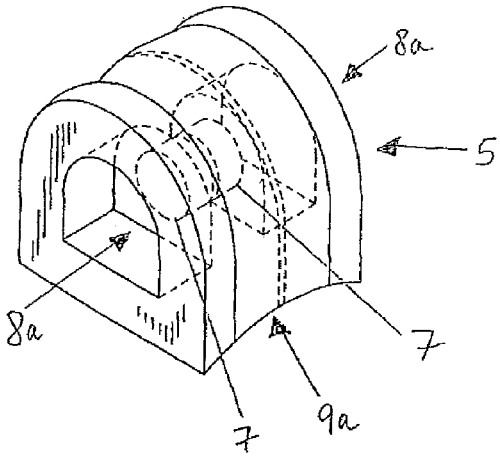
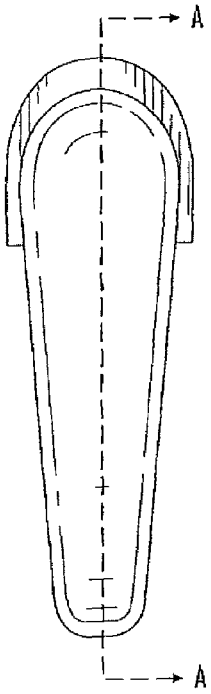
FIG. 18
FIG. 19
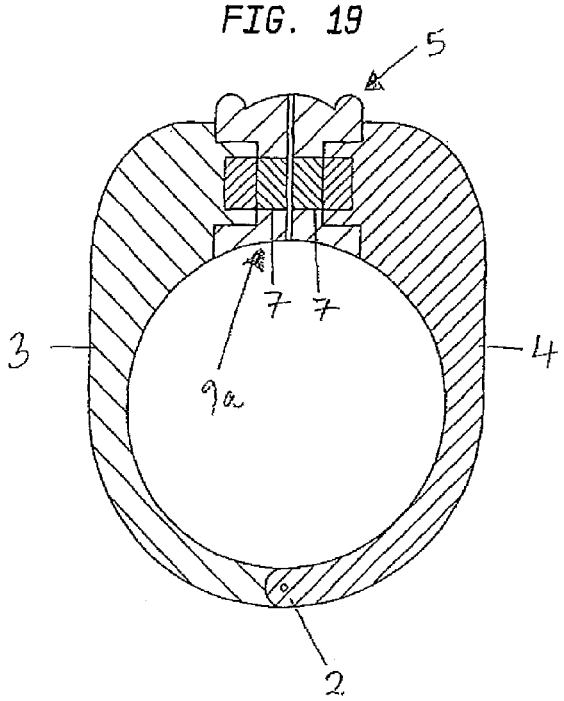

JEWELRY ARTICLE

RELATED APPLICATION

This application includes the contents of provisional patent application Ser. No. 61/713,860, filed Oct. 15, 2012 the contents of which are incorporated herein.

BACKGROUND OF THE INVENTION

The present invention relates to a jewelry article, and in particular to a jewelry article that permits the exchange of portions of the jewelry piece in order to create a variety of different looks for the piece of jewelry. The piece of jewelry can be a ring, a necklace, a pendent, a bracelet or any other type jewelry in which portions of the jewelry can be changed through attachment and detachment. The present invention also refers to a jewelry article that permit supplemental pieces to be added to a basic piece, thus changing the appearance of the jewelry piece instantaneously.

All types of jewelry are known in the prior art. Sculptured pieces are known in the prior art in the form of three dimensional pieces. Jewelry pieces can be made of all types of metal or may be carved from natural occurring material such as precious stones, semi-precious stones, shells or synthetic material. Another form of jewelry article comprises ring-shaped articles to be worn on fingers, around the neck, on arms and around the hand joint. The term ring-shaped includes also shapes that are not circular but includes any shape that has a round silhouette including octagons.

In the world of jewelry, often dictated by beauty and fashion, there is always the need for new designs; for example, the way a necklace is designed often depends on certain technical functions such as the closure or how to connect a centerpiece of a necklace; for example, a pendent to a chain. In addition, oftentimes, especially in the case of finger rings, there may be the problem of fitting a ring over the knuckles of the person's finger which makes it hard to slide the ring into place when the knuckles are big or swollen. The jewelry article of the present invention not only fulfills such a need for fitting the jewelry, but also allows for changing the appearance of the jewelry piece by exchanging portions of the jewelry piece with inserts of different shape and/or color, but also, when the present invention is implemented in a finger ring, a bangle or a necklace, makes the fitting onto the respective finger, wrist or neck extremely easy. The insert can be metal or gem stones, but also any other material fitting the design and desire. Thus, the jewelry piece of the present invention allows for endless design possibilities, while being unique and ultimately very practical.

It would therefore be desirable and advantageous to provide a novel jewelry article of new and unknown design possibilities, improved ease, versatility and beauty of the object due to the enormous number of variations that are possible with the new structural elements of the jewelry.

SUMMARY OF THE INVENTION

According to one aspect of the present invention, the article is embodied in a jewelry article including two member arms each having opposing ends and being pivotably connected to one another at respective first ends of said ends, such that in a first position, the member arms, at respective second ends opposite the first ends, are in an open position defining a space between the arms, while in a second position, the second ends of both arms are moved towards each other into a closed position, the article further includes an insert for insertion into the space between the two arms when the arms are in an open position and for connecting the insert to each of the arms when in a closed position and means for secure attachment of the insert to the arms when the arms are in the closed position.

According to another aspect of the present invention, the article includes two member arms pivotably connected at one of their ends, with the ends opposite of the pivoted ends provided with a snap closure. Upon closure, the two arms form a ring-shaped article able to hold a number of additional decorative pieces. Alternatively, an insert is placed between the member arms. Either one of these embodiments are wearable as a necklace or a bracelet. The arms of the rings-shaped article have a circular cross section but can have any cross sectional shape suitable for the purpose. Additional pieces to be added to the ring-shaped article are provided with rings or circular shapes for sliding onto the ring-shaped article and being loosely held by the ring-shaped article. The additional pieces can be purely ornamental or they can represent a chain to be worn around the neck by a wearer. Endless variations are possible for wearable jewelry such as necklaces, bracelets, earrings, rings and similar articles.

The pivoting action of the two member arms is accomplished by providing a joint connection at each of their first ends by which the member arms are movable at the first end such that the second end moves from an open position to a closed position. The joint connection may be a hinge but can be any other pivotable joint connection. Joint connections are known to those that are working in the art and are not further described here except to note there are variations that are known for such pivotable joints.

In another embodiment of this invention, a spring assist is provided at the joint connection to assist in the closing and securing of the jewelry item from the open to the closed position.

In another aspect of the invention, for attachment of the insert between the two arm members, each of the second ends of the respective member arms can be provided with recessed magnets which engage with corresponding recessed magnets placed in the insert upon moving the two member arms into the closed position.

In a further aspect of the invention, each end of the respective member where the insert is placed, can be provided with projecting connecting members that engage with corresponding openings in the insert when closing the member arms. The projecting members can also be configured as pins.

In a variation of that attachment mode, the opening in the insert can be tapered along its extension so that when rotating the insert onto the post or pin, the insert becomes "locked" into place.

As a further means of attachment, at least one of the posts can be threaded for engagement with a corresponding thread in at least one of the openings of the insert.

The insert attached to the respective members can be configured such that its shape, especially a bottom wall is curved so that it corresponds to the shape of a finger, an arm or other body part at the location where the insert will rest on the body part.

The modes of attachment of the insert can vary, for example, the insert can have a bore-through opening and the pins on each of the members may be configured as posts that have recesses for placing magnets therein. Each of the posts with the magnets slide into the bore-through opening of the insert connecting with the corresponding post from the other side via the magnets. This mode of attachment works particularly well with an insert that is bead-shaped.

In another embodiment, the attachment mode is reversed from the foregoing in that the insert is provided with a pin or post at each of its ends and the member arms are provided with recesses, such that, when placing the insert between the two members the pins or posts slide into the respective recess of each member.

The insert itself can of course be shaped in a multitude of different shapes and designs to accommodate the taste and desire of the designer or the wearer, so long as it is provided with means for connecting to the member arms.

In one embodiment, the insert is bejeweled with jewels. In another embodiment, the insert is fashioned from one or more metals. The insert can also be a pearl, pearls or a bead or several beads.

According to one embodiment of the invention, the article is a finger ring wherein the member arms form the two shanks of the ring and are pivotably joined at one end of a circular or approximately circular shape with the insert inserted between the uppermost ends of the two shanks. The shanks are connected at one end by a joint that permits a pivoting motion of the two shanks whereby the two member arms open and close to facilitate an exchange of the insert at the end opposite the joint. The joint which allows the pivoting motion at one end of the two shanks can be a hinge or any other pivotable connection, and may include a spring assist in the hinge.

According to another embodiment of the present invention, the article is configured as a bangle, which functions in the same manner as the finger ring, whereby the two members are pivotably joined together at one of their ends for moving the two arms into an open or closed position with the insert therebetween.

In another embodiment of the present invention, the members of the article consist of two semicircular rings that can be connected by means of magnets placed in recesses at each end of the semicircles. An insert, also provided with recessed magnets is lodged between the semicircular rings.

In a variation of that embodiment, instead of the members being semicircular, they have a rectangular shape. In any case, the insert can be as varied as one's imagination and strength of the magnets holding the inserts in place.

The magnetic connecting means can take on various embodiments. In one of the embodiments, magnets are received in recesses provided in each of the members, preferably in the complementary portion of each of the members. The magnets can also be covering the entire surface of the complementary portion of each arm in case the member has a rectangular shape.

BRIEF DESCRIPTION OF THE DRAWINGS

Other features and advantages of the present invention will be more readily apparent upon reading the following description of currently preferred exemplified embodiments of the invention with reference to the accompanying drawings.

FIG. 13 is another embodiment of the jewelry article in the form of a bangle having a joint and magnets inserted into each of the ends of an arm with one end provided with a thread.

FIG. 14 is a view similar to FIG. 13 showing the bangle of FIG. 13 with the arms closed.

FIG. 15 is a front and side perspective view of an insert for use in the bangle of FIG. 13 showing the inside thread in broken lines.

FIG. 16 is a top and side perspective view of another embodiment of the jewelry article showing posts, and semicircular inserts connected side-by-side with the joint in broken lines.

FIG. 17 is an enlarged front and side perspective view of the insert of FIG. 16.

FIG. 18 is a perspective side view of the jewelry article according to FIG. 17 with closed shanks.

FIG. 19 shows a sectional front view of the jewelry article of FIG. 18 along axis AA in which the posts are holding the insert.

DETAILED DESCRIPTION OF PREFERRED EMBODIMENTS

Figure 2:
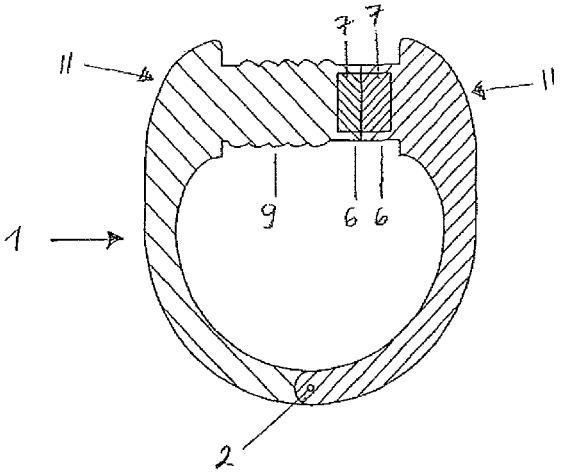
FIG. 2 is a sectional front view of the jewelry article according to FIG. 1.

Throughout all the Figures, the same or corresponding elements are generally indicated by same reference numerals.

These depicted embodiments are to be understood as illustrative of the invention and not as limiting in any way. It should also be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Figure 1:
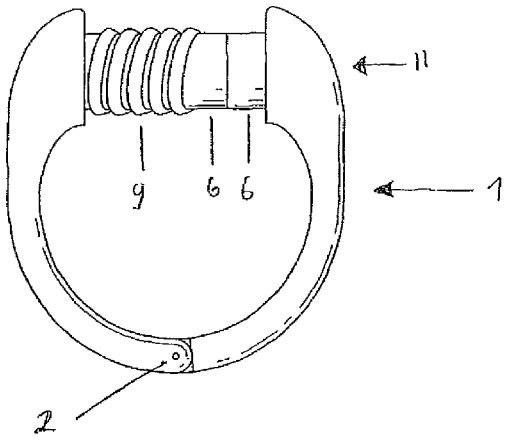
FIG. 1 is a perspective front view of an exemplary representation of a jewelry article according to the present invention in a closed state.
Figure 3:
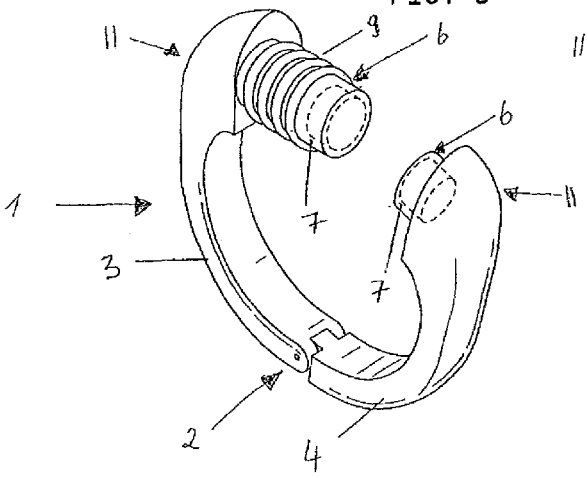
FIG. 3 is a perspective front and side view of the jewelry article according to FIG. 1 in an open state.
Figure 4:
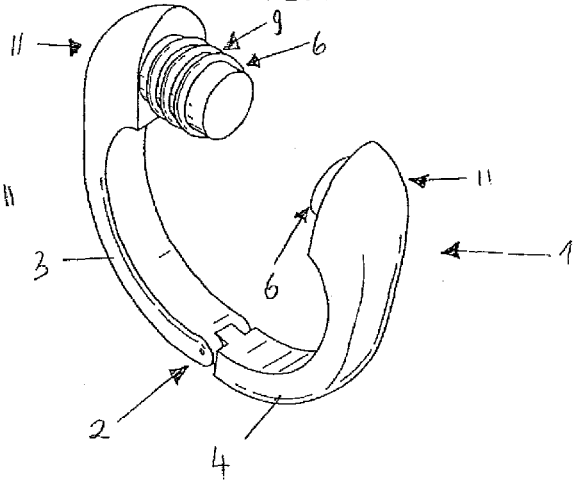
FIG. 4 is a perspective front and side view of the jewelry article according to FIG. 1 in an open state.
Figure 5:
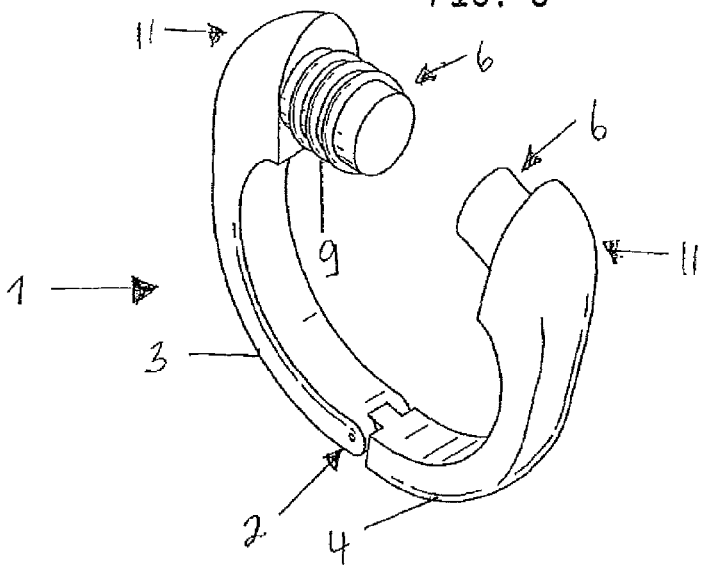
FIG. 5 is a perspective front and side view of the jewelry article according to FIG. 1 in an open state.

Turning now to the drawing, and in particular to FIG. 1, there is shown a front view of the jewelry article 1 in the form of a ring. A lateral top side view of the ring 1 is shown in FIGS. 3, 4 and 5. The ring 1 is provided with a hinge 2. FIGS. 1 and 2 show the ring 1 in a closed position and FIGS. 3 -5 show the ring in an open position pivoted about the hinge 2. FIG. 2 is the sectional view of FIG. 1. In FIGS. 3 and 4, the two arms or shanks 3, 4 are shown each having an enlarged sculpted end with projecting posts 6. Each post 6 has a recessed magnet 7. One form of insert 5 is seen in FIG. 17 with an opening 8*a* on either side and a magnet 7 lodged on the inside. Upon inserting posts 6 into the openings 8*a* in insert 5, each of the two posts 6 meet the respective magnet 7 inside of insert 5 on each side, and the magnets 7 connect as seen in FIG. 19. The curved bottom 9*a* of insert 5 is also seen in FIG. 19 which shows a sectional view of the closed ring with the hinged joint 2.

Figure 6:
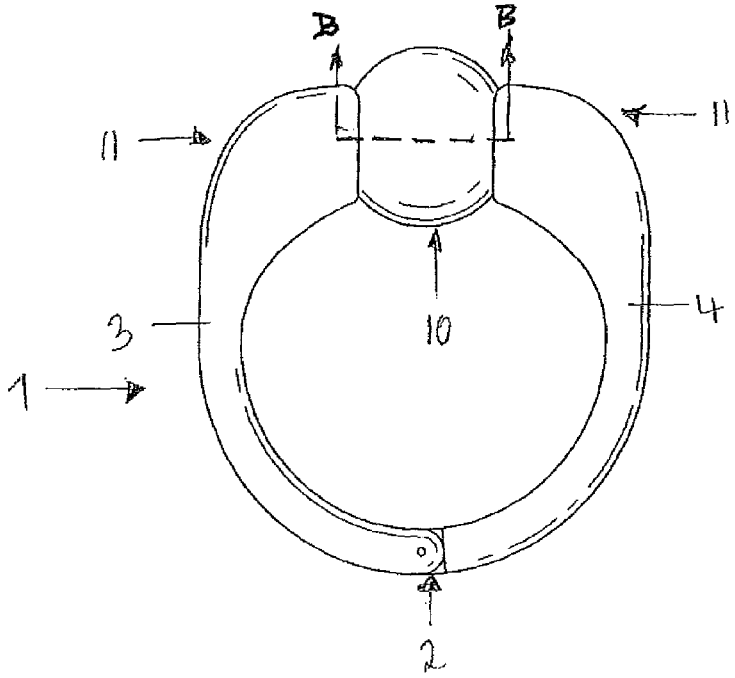
FIG. 6 is a perspective front view of the ring with closed shanks holding a bead.

FIG. 15 shows an insert 5, with one side of the insert being provided with an internal thread 10 which corresponds to the thread 9 on one of the posts 6 in the shank of the ring shown in FIG. 13. Each of the shanks or arms 3, 4 are provided with a post 6. In FIG. 13 the post carrying the thread 9 is longer than the post 6 on the opposite side. Each post 6 contains magnets 7 indicated by broken lines in the recesses 8 of the post 6. Insert 5 of FIG. 15 is screwed together with threaded post 6. The threads are arranged such that the insert 5 after screwing the insert 5 onto post 6 will be in the correct right side up position and connect to the corresponding magnet 7 inside the insert. The opposite non-threaded post 6 is then inserted into the opposite recess of the insert 5 where the corresponding magnets meet and lock. The joint 2 including each of ends 11 of the two shanks or arms 3, 4 are seen pivoted in the open position. The insert 5 is first attached whereby each of the posts 6 are received in a corresponding recess 6a of the insert 5 where the insert 5 is locked in place as shanks or arms 3 and 4 move together and are held by the magnetic connection 7. FIG. 15 shows insert 5 which is provided with a recess 6*a* which is a bore-through and an internal thread 9*a*. FIG. 17 shows the insert with a curved bottom 9*a* for a comfort fit on a finger. FIG. 19 shows the ring in a closed position to show that the two posts 6 are meeting. The posts have magnets 7 embedded in them. The ends of each shank or arm 3, 4 can bear jewels 10 as seen in FIG. 6 which can be matched to the jewels 10 of the insert 5.

Figure 7:
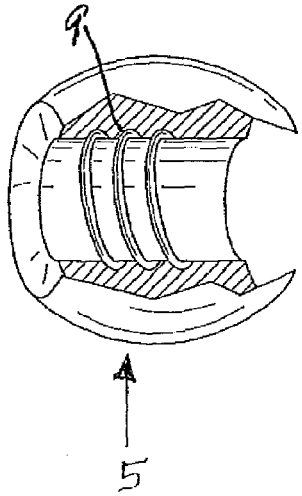
FIG. 7 is a front side cut-away view of the bead according to FIG. 6.
Figure 8:
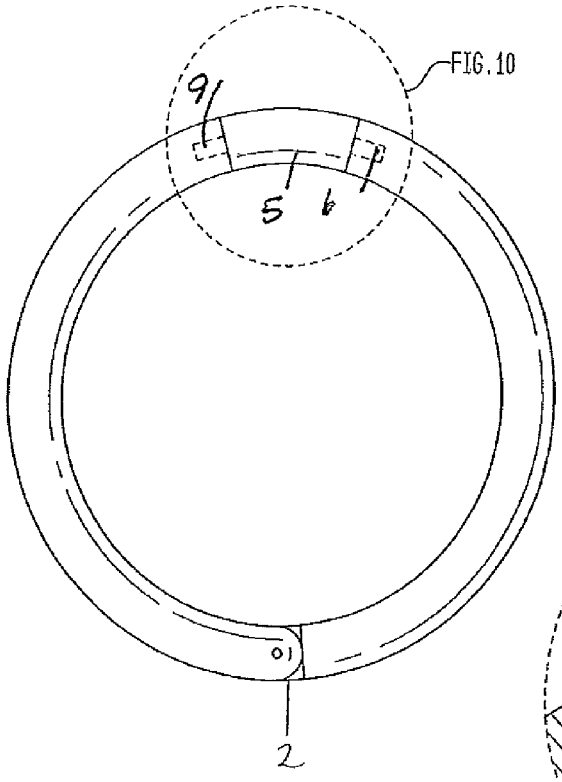
FIG. 8 is a perspective front view of the jewelry article in a closed position showing the posts holding the insert.
Figure 9:
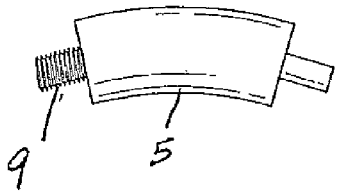
FIG. 9 is a perspective front side view of the insert shown in FIG. 8 with posts being of the same length, and one post having a thread.
Figure 10:
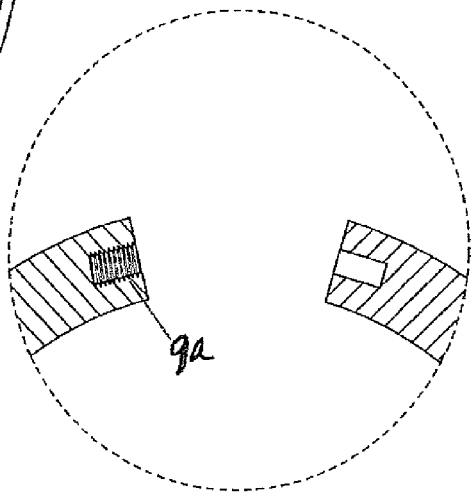
FIG. 10 is a sectional enlarged view of the shanks of the embodiment according to FIG. 8 without the insert.
Figure 11:
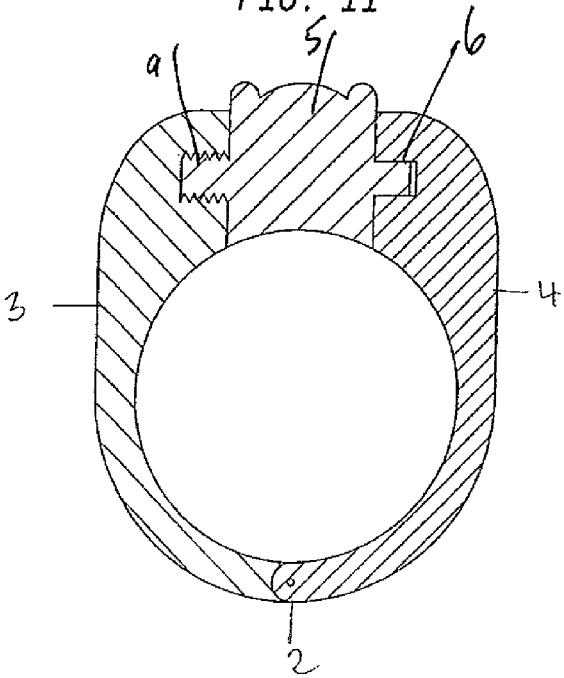
FIG. 11 is a sectional view of another embodiment of the jewelry article holding an insert, wherein the shanks are provided with recesses.
Figure 12:
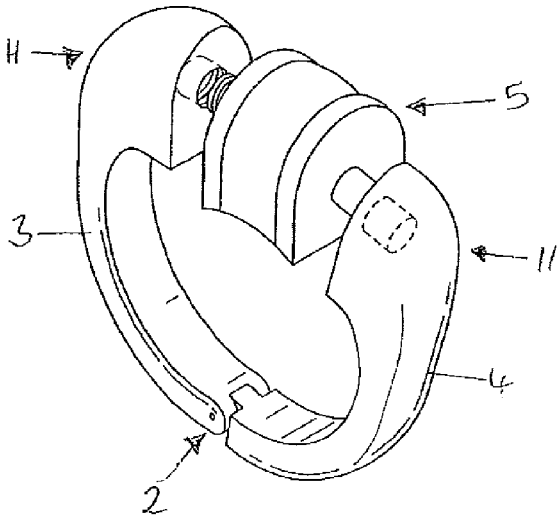
FIG. 12 is a perspective side and top view of the embodiment according to FIG. 12 with the shanks in an open position showing one of the posts with a thread.

In FIG. 3, 4, shanks 3, 4 are seen in open position with each post 6 provided with a magnet 7 indicated by broken lines. In FIG. 14 arms of a bracelet 3, 4 are seen in closed position without the insert 5. The magnets 7 are seen connected in FIG. 1. FIG. 7 shows a view along line B-B with the insert being a bead having a bore-through. As is seen in FIG. 7, a bead 5 has an internal recess 6 which is shown here as a bore-through, but need not be an entire bore-through but can be just recesses. The recess can also have a thread 9 with a corresponding thread 9 at a post 6. In a variation of the posts 6 engaging with the insert 5, FIG. 9 shows a small bead as an insert at least one of the posts is provided with a thread 9 for threadedly connecting with a corresponding thread 9*a* in the jewelry article (See FIG. 10). Another possibility is to have both a magnetic and a threaded connection with the insert 5, with at least one thread at one of the posts 6. In FIG. 12 the posts are showing to some extent, the bead will be however locked in by the threaded connection.

It should be noted that there is no limit as to the decoration of both the ends of shanks 3, 4 bearing the posts 6 or the insert 5.

FIG. 13 shows another embodiment of the article where the two member arms are formed into a bangle 10. The pivotable joint 2 allows the two member arms to be in the open position. In that position, additional ornamental pieces can be added; for example, rings or so-called charms, pieces that are provided with rings for sliding onto the article.

FIGS. 16 and 17 shows another embodiment of the article where the two insert members 5 are semicircular connected side-by-side.

Figure 20:
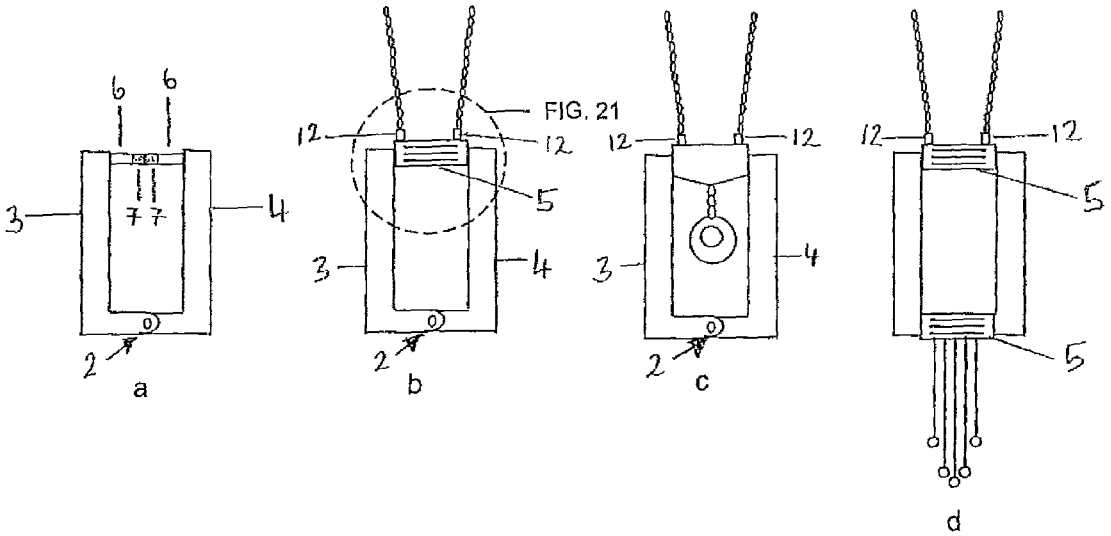
FIG. 20*a* shows a front view of rectangular shaped embodiment of the jewelry article according to the present invention.
FIG. 20*b* shows a front view of rectangular shaped embodiment of the jewelry article with insert, wherein the insert has attachment sites.
FIG. 20*c* shows a front view of another rectangular shaped embodiment of the jewelry article with insert, wherein the insert has attachment sites.
FIG. 20*d* shows a front view of another rectangular shaped embodiment of the jewelry article with two inserts.
Figure 21:
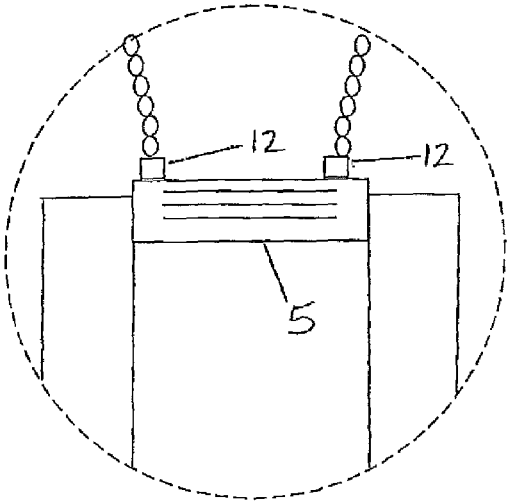
FIG. 21 shows an enlargement of the area indicated in FIG. 20 *b*.

FIGS. 20 *a-c* show a rectangular shaped embodiment of the jewelry article of the present invention. FIG. 20*a* shows the rectangular shaped jewelry article in a closed position without insert to show the posts 6 and the engaging magnets 7 which allow an insert 5 to be carried thereon. FIG. 20*b* shows the embodiment of FIG. 20*a* with an insert 5 placed on the posts. The insert 5 can be attached to for example a neck chain or other carrying devices. For this, the insert 5 can be provided with attachment sites 12 for attachment of the neck chain or other carrying device (see also FIG. 21). The attachment sites can be any type of structure that enables attachment of a chain or other carrying device to the insert such as hooks or loops. As an alternative, the insert can also be permanently connected to the chain or other carrying device by known methods such as welding or soldering. The insert can also be provided with additional attachment sites for attachment of additional decorative items as shown in FIG. 20*c*. The jewelry article according to the invention can also have more than one insert 5 to which still additional decorative items can be attached as shown in FIG. 20*d*.

Figure 22:
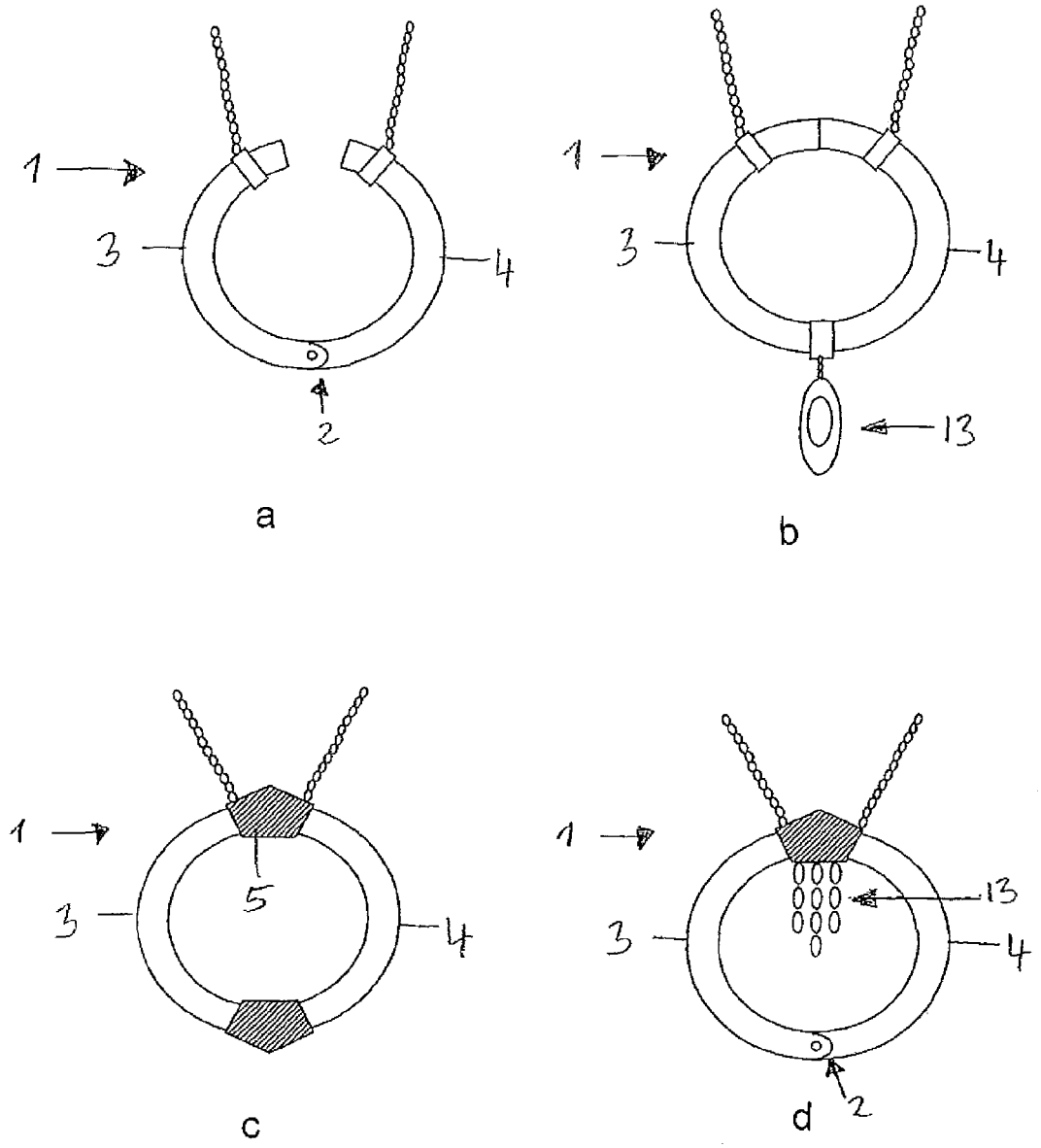
FIG. 22*a* shows a front view of a ring shaped embodiment of the jewelry article according to the invention in an open position with a neck chain attached to the ring.
FIG. 22*b* shows the embodiment of FIG. 22 *a* in a closed position with an additional decorative element held on the ring.
FIG. 22*c* shows a front view of a ring shaped embodiment of the present invention with an insert attached to a neck chain and with another decorative element.
FIG. 22*d* shows a front view of a ring shaped embodiment of the present invention with an insert attached to a neck chain and with additional decorative elements attached to the insert.

FIGS. 22*a-d* show a ring shaped embodiment of the jewelry article according to the invention. FIG. 22*a* shows the ring 1 in an open position with an attached neck chain. FIG. 22*b* shows the ring 1 in a closed position with an additional decorative item 13 placed on the ring 1. FIG. 22*c* shows the ring with insert 5 which is attached to a neck chain. The insert 5 can thus also function as attachment element to attach the ring to a neck chain or other carrying device. Again attachment sites in the form of loops or hooks or other suitable structures can be provided for this purpose or the neck chain or other carrying device can also be permanently fixed to the insert 5. As for the rectangular embodiment of the jewelry article according to the invention, the insert can also be provided with additional attachment sites for attaching additional decorative items, thereby increasing the versatility of the ring as a jewelry article.

Figure 23:
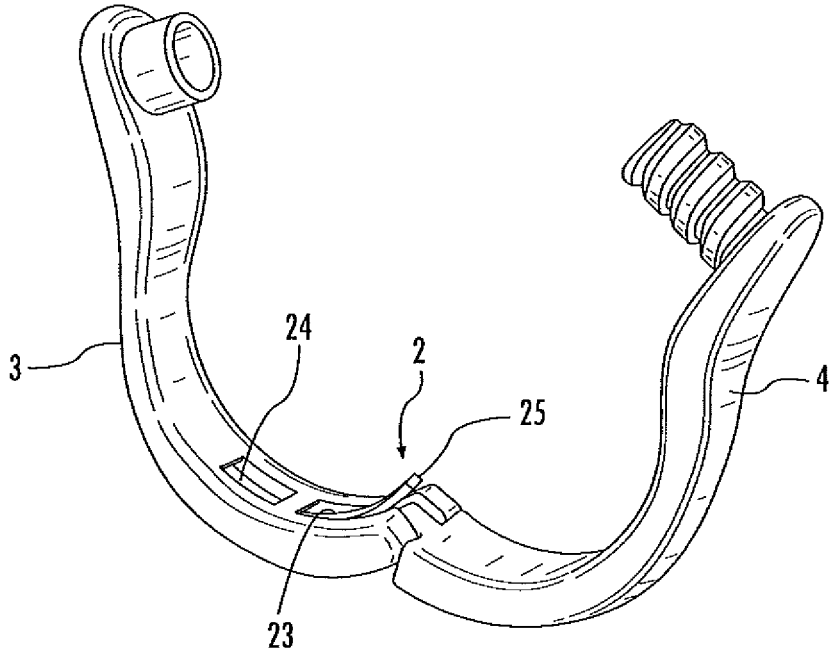
FIG. 23 is a perspective view of the ring in the open position showing the leaf spring member in the hinge thereof.
Figure 24:
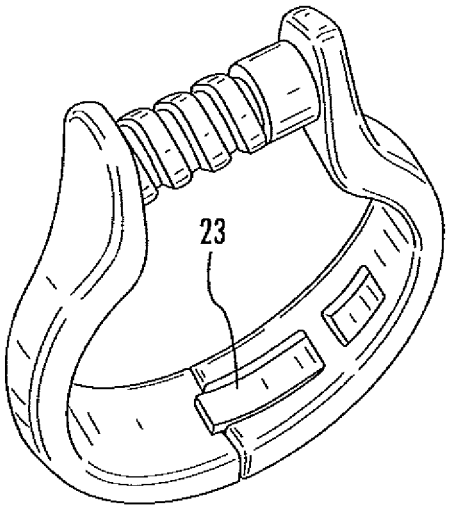
FIG. 24 is a top view of the leaf spring in the hinge connection of the jewelry item of this invention

FIGS. 23 and 24 illustrate yet a further embodiment of this invention in which the hinge connection 2 of the two arms or shanks 3 and 4 ring or bracelet is further enhanced in its closing by a leaf spring member 23 biased to the closing position. The leaf spring member 23 further snaps open to remain in its open position and as it is closed, the biasing of the spring 23 tends to more securely close the two member ring or bracelet jewelry item together. The leaf spring member 23 has one end 24 physically connected in arm or shank 3 and an opposite end 25 capable of flexing out of the silhouette of the arm or shank 3 when the ring is open.

The leaf spring member 23 may be used with any of the embodiments of this invention in the hinge 2 location. Such closing enhances the magnetic attachment between the members of the jewelry item as depicted in the above Figures.

While the invention has been illustrated and described as embodied in an interconnected split medallion jewelry article, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

It should be understood that the preferred embodiment was described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly legally and equitably entitled.

The invention claimed is:

1. A jewelry article comprising:

a pair of arms substantially matching each other and pivotably connected at a hinge to one another at respective first ends of said arms, each arm having a respective free end, said arms being moveable to be open or closed;

wherein the free end of each arm terminates in a post projecting therefrom integrally formed with said each arm, each of said posts comprising a recess formed in said projection, each of said recesses in said posts comprising respective magnets;

a separate jewelry insert located between said posts, said jewelry insert comprising a decorative structure having opposite facing ends facing respective ones of said posts, said facing ends comprising recesses located in said facing ends, said recesses in said facing ends comprising respective magnets, said magnets in said recesses in said posts and in said recesses in said facing ends being aligned with each other, said separate jewelry insert held on and between said posts by magnetic attraction between said posts and said separate jewelry insert, said arms being moved to an open position to permit changing said separate jewelry insert.

2. The article of claim 1, wherein the insert is of a substantially tubular shape.

3. The jewelry article of claim 1, wherein said first ends are connected at a hinge, and said hinge comprises a leaf spring.

4. The jewelry article of claim 3, wherein said leaf spring is biased to close said pair of arms.

5. The jewelry article of claim 1, wherein said jewelry article is a ring, wherein said decorative structure is secured to said ring.

6. A jewelry article comprising:

a pair of arms pivotably connected together and moveable between open and closed positions, each arm having a respective free end, a first post integrally formed with one of said free ends of a first of said pair of arms, said first post terminating in a recess, a magnet held in said recess of said first post, a second post integrally formed with the second of said free ends of said pair of arms, said second post terminating in a recess, a magnet held in the recess of the second post, a separate decorative insert to mount on at least one of said first or second posts when said arms are in said open position, said separate decorative insert having opposite ends terminating in respective recesses, a magnet located in each of said recesses of said opposite ends of said insert, said first and second posts moveable into said respective recesses in said opposite ends, said pair of arms being closed and magnetically attracted to each other by magnetic attraction between said first and second posts and said insert.

7. The jewelry article of claim 6, wherein the insert is of a substantially tubular shape.

8. The jewelry article of claim 6, wherein said pair of arms are pivotably connected by a hinge, said hinge comprises a leaf spring member.

9. The jewelry article of claim 8, wherein said hinge comprises a leaf spring closing assist.

* * * * *